US005899332A

United States Patent [19]

Breton et al.

[11] Patent Number: 5,899,332

[45] Date of Patent: May 4, 1999

[54] SPACER CLIP FOR HANDLING SHEET PRODUCTS

[75] Inventors: Christian Breton, Thourotte; Philippe Dereims; Jean-Robert Lefevre, both of Compiegne, all of France

[73] Assignee: Saint-Gobain Vitrage, Courbevoie, France

[21] Appl. No.: 08/953,665

[22] Filed: Oct. 17, 1997

[30] Foreign Application Priority Data

Oct. 17, 1996 [FR] France ..... 96 12656

[51] Int. Cl.[6] ..... B65D 85/48

[52] U.S. Cl. ..... 206/453; 206/451; 206/448; 24/545; 24/561

[58] Field of Search ..... 206/340, 448, 206/453, 451, 586; 24/489, 499, 511, 545, 555, 561

[56] References Cited

FOREIGN PATENT DOCUMENTS 192220 8/1986 European Pat. Off. .
9209052 10/1992 Germany .

*Primary Examiner*—David T. Fidei
*Attorney, Agent, or Firm*—Oblon, Spivak, McClelland, Maier & Neustadt, P.C.

[57] ABSTRACT

A spacer clip allows sheet products such as panes of glass to be handled and transported. The upper part (2) of the spacer clip, which rests on at least one part of the edge face of a sheet product, is in contact with at least one other spacer clip positioned on a sheet product next to the product. Contact between the upper part (2) of the clip and the upper part (2) of each of the other neighboring spacer clips is along a generatrix (15).

10 Claims, 3 Drawing Sheets

SPACER CLIP FOR HANDLING SHEET PRODUCTS

BACKGROUND OF THE INVENTION

1. Field of the Invention

The invention relates to a spacer clip allowing sheet products such as panes of glass, and especially windscreens, rear screens or side windows, of motor vehicles to be handled and transported.

2. Description of the Related Art

Devices allowing sheets of glass, especially windscreens, to be handled and transported are known. A device of this kind is described, for example, in French patent application 2,506,728. This application describes a metal pallet or box forming a floor and provided with vertical curtain walls intended to protect the sheets of glass which are standing edgewise thereon.

To space the panes of glass apart, they are placed in the gaps between the teeth of racks arranged on the floor of the pallet. The gaps are as wide as the thickness of the sheets to be transported so that the sheets can be held fast.

Spacer clips intended to maintain the spacing between two sheets of glass over their entire area are placed on the upper edges of the glass sheets. These spacer clips may also provide supports for binding straps or bars, avoiding the risk of damaging the edges of the glass panes.

These devices are very widely used in the glazing industry for handling panes of glass. Improvements have already been made to these types of devices. For example, the materials of which the "boxes" are made have been modified to make them lighter, and the shapes of the "boxes" have been modified to reduce the amount of space they occupy when they are not in use. An important advantage of these pallets or boxes is that they can be reused.

As regards the insert clips, it is advantageous for their upper part to have an essentially horizontal surface, especially to provide a region suited to the passage of binding straps or bars. When a clip is placed on a sheet of glass, the position of its upper surface depends on the inclination of the panes of glass; these panes are not stored or transported precisely upright but always slightly inclined to make the "stacked" products more stable, this inclination being given by the gaps between teeth of the rack arranged on the floor of the pallet or box.

To compensate for this inclination, a common approach is to make such clips in such a way that the upper surface is at an angle to the direction of the jaws, so that this upper surface is more or less horizontal when the clip is placed on the pane of glass.

Added to this inclination is another inclination due to the shape of the pane of glass, especially when this pane is curved in the vertical direction, as arranged on the pallet. As the spacer clip straddles the edge of a sheet of glass, the direction given to the jaws is a tangent to the edge of the sheet and therefore depends on the curvature of the latter in the vertical direction. As panes of glass for motor vehicles, whether they be windscreens, rear screens or even side windows, increasingly have two curvatures, i.e., curvatures in two directions perpendicular to each other, a curvature in the vertical direction when the panes of glass are stacked on a box or pallet is very often encountered. This second inclination which is due to the curvature of the sheets of glass can also be compensated for by the angle between the upper surface and the direction of the lower jaws of the clip.

In contrast, although the inclination of the sheets of glass on a pallet can be made constant irrespective of the pallet or the sheets of glass, the inclination due to the curvature of the sheets of glass will vary from one series of sheets to another.

At present, it is necessary to have one type of spacer clip for each type of sheet of glass, so that the upper surfaces of the clips are always more or less horizontal. This solution is feasible but has many drawbacks: first, it leads to high costs because it is necessary to have several manufacturing molds, usually employed for short runs. In addition, it is necessary for each workshop that prepares the pallets to have a stock of various types of spacer clips. Furthermore, each type of clip needs to be indexed to let the operator know which clips correspond to a particular type of pane of glass. These requirements inevitably lead to higher costs.

SUMMARY OF THE INVENTION

It is an object of the invention to eliminate the aforementioned drawbacks.

It is a further object of the invention to provide a single type of spacer clip that suits all types of panes of glass, irrespective of their shape.

Another object of the invention is to provide spacer clips which both act as inserts or spacers between the sheets of glass and, in combination with one another, also provide a horizontal surface that can hold the binding straps or bars with no risk of damaging the edge of the glass pane.

Yet a further object of the invention is to provide spacer clips which may be be placed on the upper edges of sheet products arranged in a box to be in contact with one another.

The above and other objects are achieved according to the invention by a spacer clip for sheet products such as panes of glass, which is composed of an upper part intended to rest on at least one part of the edge face of a product and a lower part composed of two jaws each intended to rest on one face of the said product and which is positioned on the upper edges of the product in such a way that it is in contact with at least one other spacer clip positioned on a sheet product next to the said product, contact between the upper part of the clip and the upper part of the neighboring spacer clips being along a generatrix.

The spacer clip is thus in contact with other clips and acts as a spacer or insert. As contact is along a generatrix, the pressure exerted on each clip is spread along the generatrix. Thus, when the pressure is high, the clip is strong enough to avoid being crushed. It is possible to position several clips on each product. In this way, the clips are subjected to lower pressures than if there were just one clip arranged on the product.

Furthermore, the contact generatrix depends on the orientation direction of the jaws with respect to the vertical, and it is thus possible to use this spacer clip irrespective of the direction of the jaws due to its shape and/or the inclination of the sheet product. This is because the spacer clip is always in contact along a generatrix whether or not the sheet product on which it is positioned is vertically curved, the contact along the generatrix varying with the shape and angle of inclination of the product. Thus the spacer clip suits various types of sheet products, such as panes of glass, irrespective of their shape and/or inclination.

In an alternative form of the invention, the contact generatrix is a discontinuous line, contact between the clips advantageously being on the lateral ends of the upper part, the discontinuous form of the generatrix is a result of the shape given to the upper part of the clip, which shape satisfies the various functions required of the clip. The contact along a discontinuous generatrix is enough to ensure uniform spread of pressure exerted by the clips on one another.

In a preferred embodiment of the invention, the upper part of the clip is at least partially cylindrical, the surface of the said cylinder being generated by shifting the contact generatrix, that is to say by the whole set of possible contact generatrices. This cylindrical shape makes it possible to obtain contact along a generatrix irrespective of the direction of the jaws.

Preferably too, the lateral ends of the upper part are at least partially cylindrical with a circular base. In this alternative form, contact between clips is along a discontinuous generatrix. The axis of the said cylinder of circular base is preferably horizontal and parallel to each of the planes formed by the jaws. Thus the upper part is off-centered with respect to the jaws. The off-centering makes it possible to obtain a whole set of possible contact generatrices, the set being determined by the various angles of inclination of the pane of glass and/or angles of inclination due to the shape of the pane of glass, it being possible for the combined value of these angles to be as high as 45°. In addition, thanks to this off-centering, the upper part does not have an excessively thick cylindrical section. This advantage is not insignificant, because the size of the cylindrical section, that is the width of the upper part, is governed by the desired spacing between the panes of glass when they are arranged on the pallets, which spacing needs to be as small as possible to avoid contact between surfaces of products facing each other, while permitting the maximum number of products on the pallets or boxes.

In an alternative form of the invention, the upper part advantageously has complementary shapes on each of its faces, allowing two clips to fit one inside the other. It is thus possible to position the spacer clips in line with one another, each of being nested in the neighboring spacer clip. The clips thus arranged form a strip, at the top of the sheet products, across which it is possible to place more or less horizontally a binding bar or strap so as to hold the products in place in the box while they are being handled.

Preferably, the upper part of the spacer clip has an indented region at its top allowing the passage of a binding strap or bar. The latter may be fitted very easily and there is no risk of it slipping sideways during handling.

In an advantageous alternative form of the invention, contact between the indented region and the binding strap or bar is at least linear. In actual fact, the binding strap or bar does not necessarily need to rest on a flat surface for the products to be held in place. Of course the invention is not restricted to linear contact.

The spacer clips according to the invention are advantageously used for handling panes of glass stacked on pallets or boxes and in particular for panes of glass such as windscreens, rear screens or side windows for motor vehicles which at least have curved regions on the edge of their periphery.

According to the invention, the whole set of such spacer clips arranged on the upper edges of the panes of glass makes it possible to form a strip at the edge of the stack of panes so that each spacer clip is in contact with at least one other spacer clip along a generatrix that depends on the direction given to the jaws.

The spacer clip which has just been described is therefore suited to all types of pane of glass irrespective of its shape, and combining it with other spacer clips of the same type gives a horizontal surface that can accept the binding straps or bars without any risk of damage to the edge of the panes of glass.

Preferably, the internal faces of the jaws converge, so that the clip is better held on the pane of glass thanks to the pinching of the jaws.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

In the following description, "horizontal" is understood to mean parallel to the floor of the box or pallet and "vertical" is understood to mean perpendicular to the floor of the box or pallet.

Figure 1:
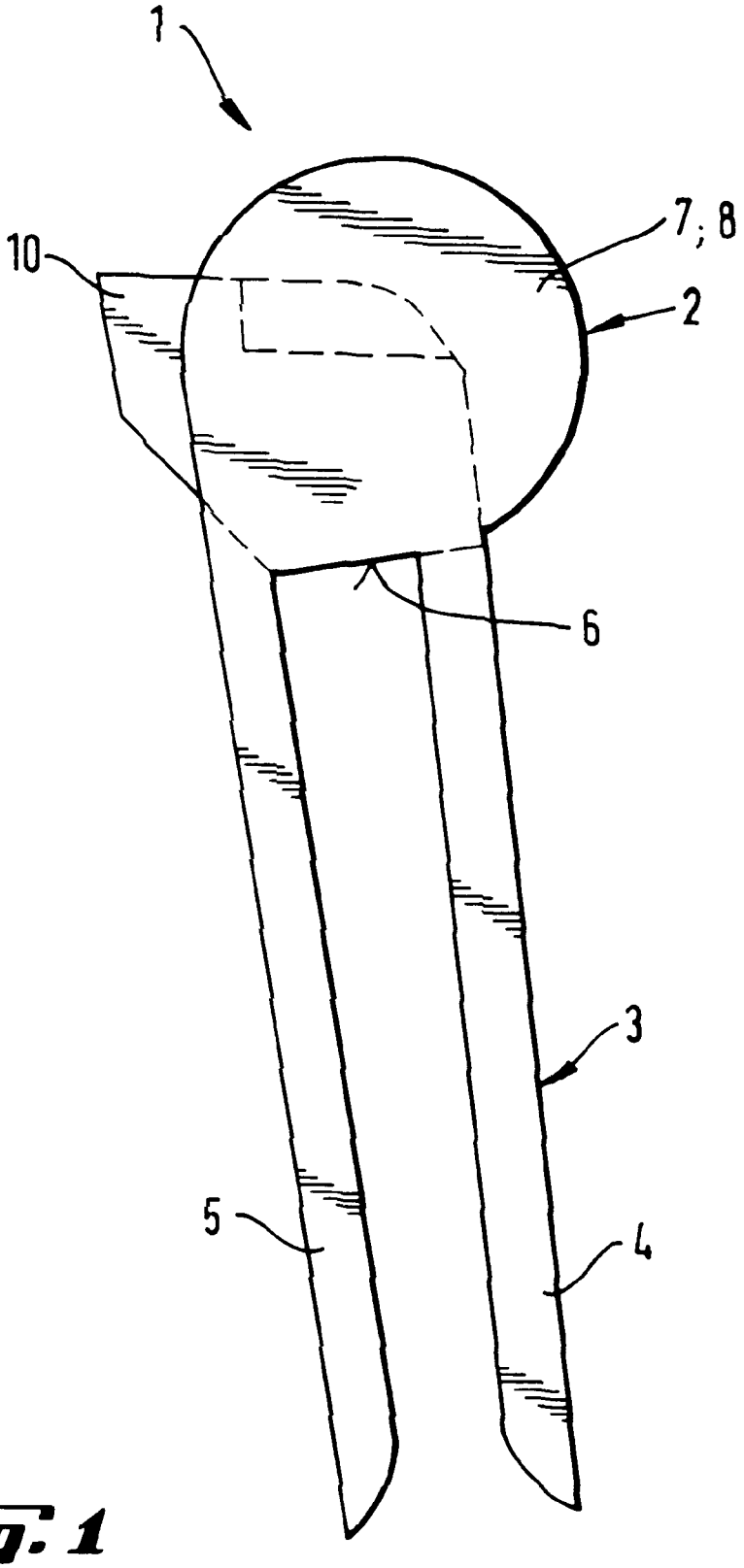
FIG. 1 is a side elevation of a spacer clip according to the invention.

FIG. 1 depicts a spacer clip 1 according to the invention. It is composed of an upper part 2 and a lower part 3, itself composed of two jaws 4 and 5. The terms "upper" and "lower" are defined in relation to the position that a clip of this type will adopt at the top of a pane of glass. When the clip is placed on the upper edge of a pane of glass, the part 2 is placed above the jaws 4 and 5 which rest on the faces of the pane of glass, and the lower face 6 of the upper part 2 rests on at least one part of the edge face of the pane of glass.

Figure 2:
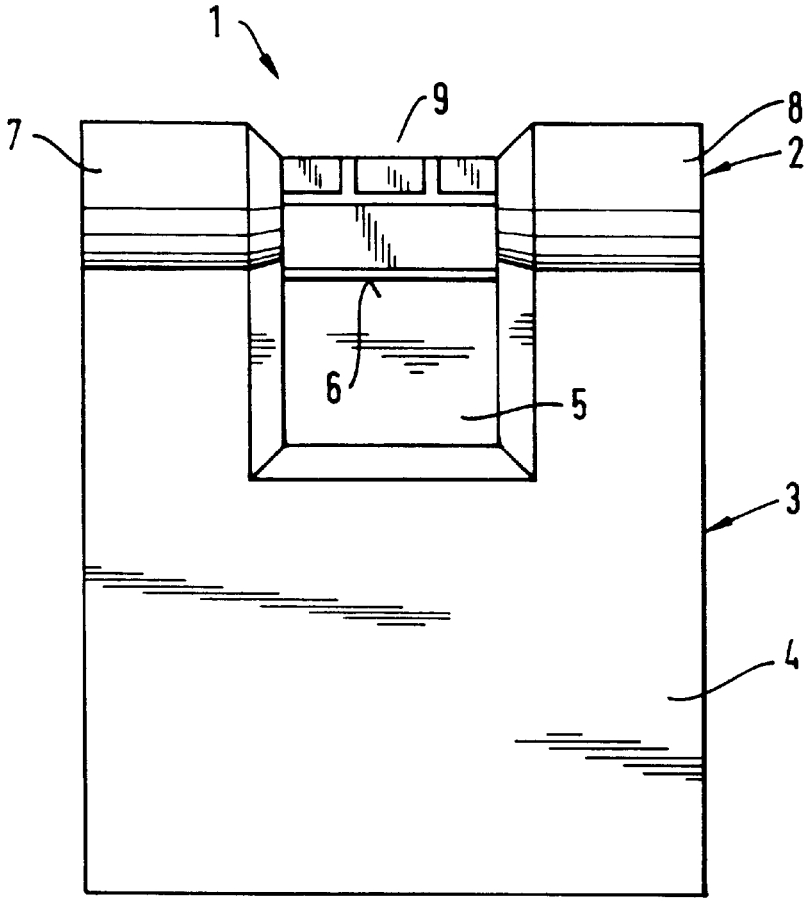
FIG. 2 is a front elevation of the spacer clip of FIG. 1.

FIG. 2 is a front view of the spacer clip 1 according to the invention. It shows the indented region 9 on the upper part 2 of the clip 1. This indented region 9 is designed to hold a binding strap or bar. The straps or bars, not shown in the figures, are used to keep the panes of glass in place when they are on the pallet or box. By running the binding bar or strap over the clips 1, direct contact between the straps or bars and the edge face of the pane of glass, which could damage the panes of glass, is avoided. The indented regions 9 form a sort of recessed track when the clips are placed on adjacent panes of glass, and so retain the strap or bar and prevent any lateral slipping thereof which might permit them to contact the edge face of the pane of glass.

FIG. 2, in conjunction with FIG. 1, illustrates the cylindrical shape, with circular base, of the lateral ends 7 and 8 of the upper part 2. FIG. 1 clearly shows the offset of the cylinder with respect to the jaws 4 and 5. This special shape of the ends 7 and 8 of the upper part 2 will be explained later.

Figure 3:
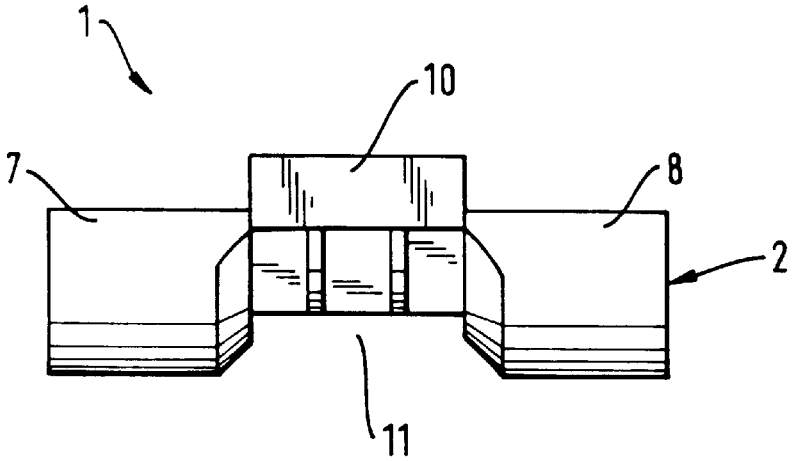
FIG. 3 is a plan view of the clip of FIG. 1.

FIG. 3, which is a plan view of the spacer clip 1 according to the invention, shows a protruding part 10 and of a recessed part 11 which have complementary shapes. The spacer clips 1 can fit one inside the other when they are mounted in alignment on the panes of glass. They therefore fit together by virtue of the protruding part 10 of one clip entering the recessed part 11 of another clip. The immobilization thus achieved is only in the lateral sense and allows a pane of glass placed in a box to be withdrawn upwardly.

Figure 4:
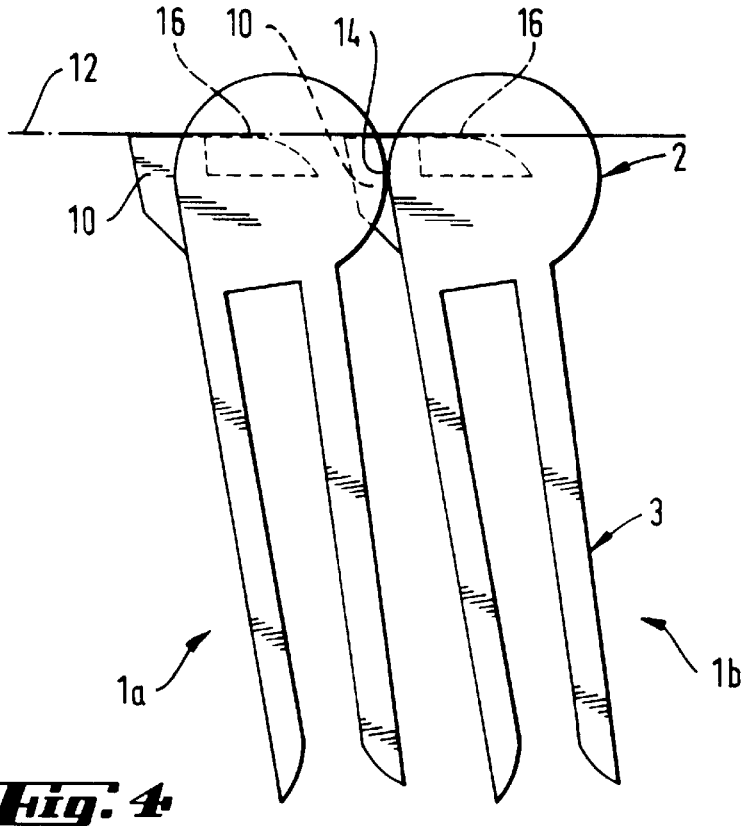
FIGS. 4 and 5 are respectively side elevations of two spacer clips according to the invention, at two different angles of inclination.
Figure 5:
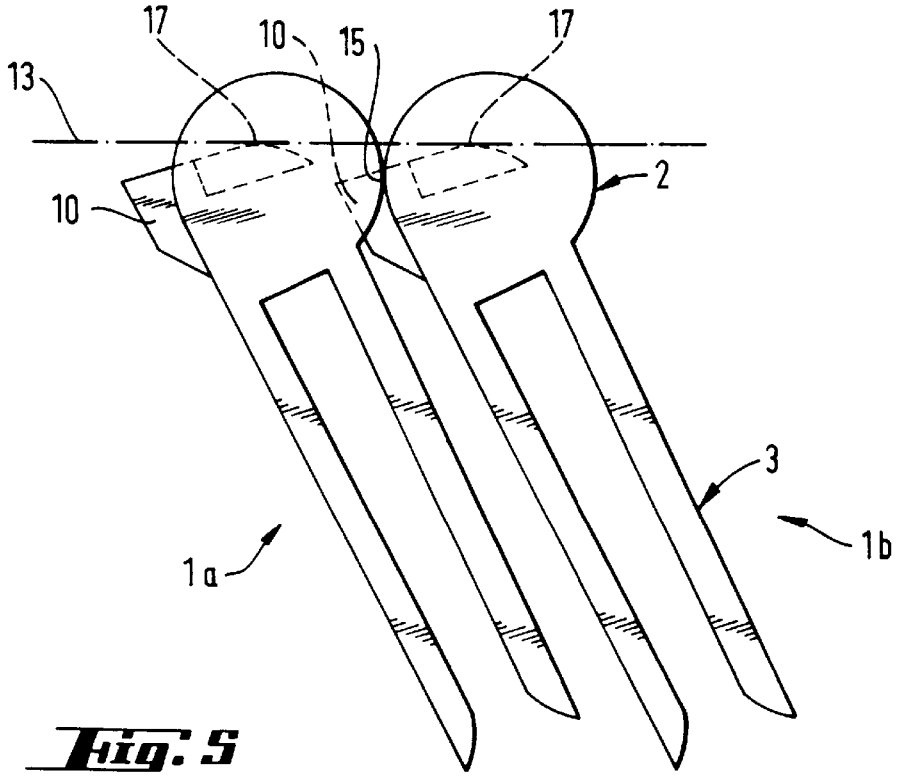

FIGS. 4 and 5 are side views of two spacer clips 1(*a*) and 1(*b*) according to the invention, in contact at two different angles of inclination. The points of contact 14 or 15 of the two contact generatrices can be clearly seen. The points of contact 14 or 15 differ depending on the angular orientation to the jaws. For the clip 1(*a*), the point 14 is higher up than the point 15, and conversely for the clip 1(*b*) the point 14 is lower than the point 15. The offset cylindrical shape of the lateral ends 7 and 8 of the upper part 2 enables the contact between two clips to be located at a position along a generatrix which depends on the inclination of the jaws due to the shape of the pane of glass and on the inclination of the panes of glass on the pallet or the box. It is possible for the jaws to have a maximum inclination of as much as 45°.

In an alternative form, where there is no indented part 9, this cylindrical shape also allows a more or less horizontal plane, which plane is not depicted in the figures, to be provided for a binding bar or strap when the various clips are arranged on the upper edges of the pane of glass in such a way that they form a strip.

In the preferred alternative form, the indented regions 9 appear in FIGS. 4 and 5. It can be seen that the tops of these regions form a horizontal resting plane 12 or 13 irrespective of the inclination of the jaws.

In FIG. 4, this resting plane 12 is the combination of several flat surfaces formed by the surfaces 16, while in FIG. 5, this resting plane 13 is the combination of several straight-line segments, formed by the points 17. In point of fact, contact between the binding strap or bar and the indented region 9 may simply be linear or flat. In this embodiment, whether this contact is linear or flat will depend on the inclination given to the jaws by the pane of glass.

Furthermore, FIG. 4 depicts two spacer clips 1 in contact when they are arranged on panes of glass which do not have vertical curvature, that is, the point 14 is the uppermost point of contact that can be obtained between two spacers clips 1. It can be seen that the direction of the jaws forms an angle with the perpendicular to the plane 12. This direction of the jaws corresponds to the inclination of the uncurved articles on the pallet or box. In actual fact, panes of glass are not stored vertically but always slightly at an angle so as to obtain greater stability. Thus, to compensate for this inclination, the jaws are given a predetermined initial direction with respect to the plane 12, which depends on this inclination.

The spacer clip thus described can fulfil the various desired functions: separating the sheets of glass from one another when they are stacked on boxes or pallets and offering a surface to support the binding straps or bars. Furthermore, contrary to the conventional solutions, this spacer clip can be used with various types of panes of glass, which limits the cost of manufacturing and storing different types of clip.

Obviously, numerous modifications and variations of the present invention are possible in light of the above teachings. It is therefore to be understood that the invention may be practiced otherwise than as specifically described herein.

We claim:

1. A spacer clip for sheet products, comprising:

an upper part having a surface formed at least in part by a a partially cylindrical surface; and a lower part including two jaws extending from said upper part, each of said jaws being engageable with a face of a sheet product, wherein said partially cylindrical surface is offset with respect to said jaws.

2. The spacer clip according to claim 1, wherein ends of the upper part are at least partially by said partially cylindrical surface.

3. The spacer clip according to claim 2, wherein the cylindrical axis of the cylinder of the upper part extends substantially parallel to planes formed by the jaws.

4. The spacer clip according to claim 1, wherein the upper part has opposing complementary shapes thereon, allowing adjacent clips to fit one inside another.

5. The spacer clip according to claim 1, wherein a middle portion of the upper part has an upper region which is indented sufficiently to permit the passage of a binding strap or bar. are at least partially by said partially cylindrical surface.

6. The spacer clip according to claim 5, wherein a contact between the indented region and the binding strap or bar is a least partially linear.

7. An assembly comprising:

panes of glass stacked in parallel on pallets or boxes; and spacer clips mounted in alignment on said panes, each of said spacer clips comprising an upper part extending beyond at least one part of an edge face of the glass pane to which the spacer clip is mounted, and having a surface formed at least in part by a partially cylindrical surface, and a lower part including two jaws extending from said upper part, each of said jaws being engageable with a face of the glass pane to which the spacer clip is mounted, wherein said partially cylindrical surface is offset with respect to said jaws.

wherein said lower part has an orientation with respect to said upper part such that the upper parts of said clips on adjacent ones of the glass panes contact one another along the surface of the upper part.

8. The assembly of claim 7, wherein the panes of glass comprise at least one of windscreens, rear screens and side windows for motor vehicles and have curved regions.

9. A spacer clip for sheet products, comprising:

an upper part comprising two partially cylindrical ends, and between said ends comprises an indented region which is indented with respect to said partially cylindrical ends and which forms a recessed track;

a lower part including two jaws extending from said upper part, each of said jaws being engageable with a face of a sheet product, said cylindrical parts being centered offset with respect to said jaws.

10. The spacer clip of claim 9, further comprising a projection extending from said upper part in a direction opposite the offset of said cylindrical parts, said projection having an orientation and shape complementary to said indented region.

* * * * *